US007222902B2

(12) United States Patent
Slezak et al.

(10) Patent No.: US 7,222,902 B2
(45) Date of Patent: May 29, 2007

(54) SPOOL HANDLING DEVICE

(75) Inventors: Raymond J. Slezak, Barberton, OH (US); Charles J. Winafeld, North Canton, OH (US); Cheryl K. Hamilton, North Canton, OH (US)

(73) Assignee: RJS Corporation, Akron, OH (US)

( * ) Notice: Subject to any disclaimer, the term of this patent is extended or adjusted under 35 U.S.C. 154(b) by 203 days.

(21) Appl. No.: 11/041,591

(22) Filed: Jan. 21, 2005

(65) Prior Publication Data

US 2006/0163891 A1 Jul. 27, 2006

(51) Int. Cl.
*B66C 1/66* (2006.01)

(52) U.S. Cl. ..... 294/67.22; 294/86.41; 414/910; 414/911

(58) Field of Classification Search ..... 294/67.2, 294/67.22, 67.31, 67.5, 86.41, 117; 414/910, 414/911

See application file for complete search history.

(56) References Cited

U.S. PATENT DOCUMENTS

| | | | | |
|---|---|---|---|---|
| 2,744,780 A | | 5/1956 | Dixon | 294/115 |
| 2,752,191 A | | 6/1956 | Pierce | 294/93 |
| 2,984,513 A | | 5/1961 | Nearman | 294/67 |
| 3,258,287 A | | 6/1966 | Crosby | 294/67 |
| 4,154,470 A | | 5/1979 | Dalglish | 294/93 |
| 4,245,861 A | | 1/1981 | Harry et al. | 294/94 |
| 4,358,143 A | | 11/1982 | Cullen | 294/64 |
| 4,375,936 A | | 3/1983 | Dechantsreiter | 414/626 |
| 4,515,522 A | * | 5/1985 | Sonerud | 414/745.4 |
| 4,557,515 A | | 12/1985 | Read | 294/67.22 |
| 4,685,711 A | * | 8/1987 | Zuber | 294/86.41 |
| 4,687,244 A | | 8/1987 | Cullen et al. | 294/86.41 |
| 4,797,059 A | | 1/1989 | Karg et al. | 414/590 |
| 4,929,012 A | | 5/1990 | Slezak | 294/86.41 |
| 5,024,477 A | | 6/1991 | Slezak | 294/81.2 |
| 5,688,009 A | * | 11/1997 | Pienta | 294/67.2 |
| 6,089,633 A | | 7/2000 | Jacob | 294/67.22 |
| 6,116,669 A | | 9/2000 | Scaglia | 294/67.22 |
| 6,354,644 B1 | | 3/2002 | Zaguroli, Jr. et al. | 294/67.22 |
| 6,402,213 B1 | | 6/2002 | Scaglia | 294/67.22 |
| 6,619,711 B2 | | 9/2003 | Scaglia | 294/67.22 |
| 6,733,058 B1 | | 5/2004 | Nakajima | 297/86.41 |

* cited by examiner

*Primary Examiner*—Dean J. Kramer
(74) *Attorney, Agent, or Firm*—Renner Kenner Greive Bobak Taylor & Weber

(57) ABSTRACT

A spool handling device (10) for engaging and disengaging a spool (5) having, a base (14), a spindle (15) supported by the base and adapted to receive the spool, a latch assembly (74) pivotally mounted relative to the base and including a latch (76) for releasably securing the spool on the spindle, and an ejection arm (77) for assisting in removal of the spool from the spindle.

20 Claims, 5 Drawing Sheets

SPOOL HANDLING DEVICE

TECHNICAL FIELD

The present invention relates generally to a spool handling device. More particularly, the present invention relates to a spool handling device for grasping a spool so that it can be vertically lifted or lowered using a hoist. More specifically, the present invention relates to a spool handling device which enables the releasable engagement of a spool so that it can be vertically lifted or lowered using a hoist and selectively oriented with relative ease.

BACKGROUND ART

There are various types of manufacturing processes which involve the combination of a plurality of strands of cords, cables, wires or the like which during processing are combined with each other, with other materials, or both. Where it is necessary to combine a plurality of such strands of material during either continuous or intermittent manufacturing operations, it is frequently convenient that the strands be coiled such as to provide the capability of continuously feeding out substantial lengths of the strands. In order to have available in a manageable form substantial lengths of coiled strands, it is commonly known to employ spools. The coiled strands are reeved around the spools for storage, and can be dispensed through rotation of the spools about the longitudinal axis thereof.

One such example of the employment of spools to store and dispense coiled strands is involved in the rubber industry. For example, in the rubber industry it is common to simultaneously employ a plurality of steel reinforcing cords which are stored on and dispensed from spools. The spools are normally mounted in an array which is commonly referred to as a creel. While creels may differ in various details they commonly consist of an array of spindles which are mounted in a substantially vertical framework having spindles which may project therefrom.

Each spool includes a body portion on which the steel cord is reeved, a receiving aperture extending through the body portion, and two (2) flanges extending radially outwardly from the ends of the body portion. The steel cord is reeved between the flanges, and the receiving aperture is adapted to engage the spindles of the creels. Furthermore, while the spools employed for steel cord are normally constructed of relatively light metal materials, the full spool with its capacity of steel cord approaching the radially outer extremity of the flanges may weigh on the order of forty to eighty pounds.

The spools are normally packaged in standard rectangular shipping cartons or containers in which the spools are tightly packed in circumferential engagement with adjacent spools in an upright position with longitudinal axis vertically aligned. Cartons are commonly sized such as to receive three spool by four spool layers arranged in three layers constituting a total of 36 spools. In some instances, the containers may accommodate 72 spools having a reduced axial length.

In many manufacturing operations, the cartons are positioned proximate to the creels, and an operator manually removes empty spools from the spindles and replaces them with full spools of steel cord. While manual loading of the creels is possible, it has the disadvantage that over the period of a work day, an operator may become sufficiently fatigued, particularly in relation to the placement of spools on the higher spindles, that the overall loading time for creels may become excessively long. In addition, the size and strength of an operator becomes highly significant in effecting the loading of spools over a period of time.

Therefore, in order to obviate a high degree of reliance on the size and strength of operators, there is a need for a spool handling device which provides for the releasable engagement of the spool so that it can be vertically lifted or lowered with relative ease using a hoist.

DISCLOSURE OF THE INVENTION

Therefore, an object of the present invention is to provide a spool handling device suitable for use with a hoist. Another object of the present invention is to provide a spool handling device providing for the releasable engagement of spool. Yet another objection of the present invention is to provide a spool handling device which obviates to a high degree reliance on the size and strength of operators, and that can be repositioned with relative ease using a hoist.

A further object of the present invention is to provide a spool handing device employing a mechanical latch assembly releasably securing a spool on a spindle. A still further object of the present invention is to provide a mechanical latch assembly including a latch used to engage a spool received on a spindle. Another object of the present invention is to provide a mechanical latch assembly including an ejection arm used to assist in removal of a spool from a spindle. Yet a further object of the present invention is to provide a mechanical latch assembly configured such that, if a spool begins to slide off a spindle without the operator actuating the push-off arm, the force exerted by the spool against the latch assembly serves to assist in keeping the latch engaged and thus retaining the spool on the spindle.

Still another object of the invention is to provide a spool handling device that is noncomplex, manually actuated, low cost, low maintenance yet highly effective and ergonomically friendly in grasping and handling spools.

In general, the present invention contemplates spool handling device for engaging and disengaging a spool having, a base, a spindle supported by the base and adapted to receive the spool, a latch assembly pivotally mounted relative to the base and including a latch for releasably securing the spool on the spindle, and an ejection arm for assisting in removal of the spool from the spindle.

BEST MODE FOR CARRYING OUT THE INVENTION

A spool handling device according to the concepts of the present invention is generally indicated by the numeral 10 in the accompanying drawings. The spool handling device 10 is provided to allow a operator to grip a spool S of steel cord or other material. As such, the spool handling device 10 provides for the releasable engagement of the spool S so that it can be vertically lifted or lowered and manipulated with relative ease. Generally, the spool S includes a body portion on which the steel cord or other material is reeved, a receiving aperture A extending through the body portion, and two flanges R extending radially outwardly from the ends of the body portion. As described below, to grasp the spool, the spool handling device 10 includes components which are latched onto one of the flanges R, and inserted into the receiving aperture A.

The spool handling device 10 can be attached to a hoist (not shown) capable of vertically repositioning the spool handling device 10. Furthermore, the hoist can be attached to a overhead carriage (not shown) to facilitate transport of the spool. As such, once the spool is in releasable engagement with spool handling device 10, an operator can use the hoist to vertically reposition the spool, and use the overhead carriage to transport the spool to a desired location.

Figure 1:
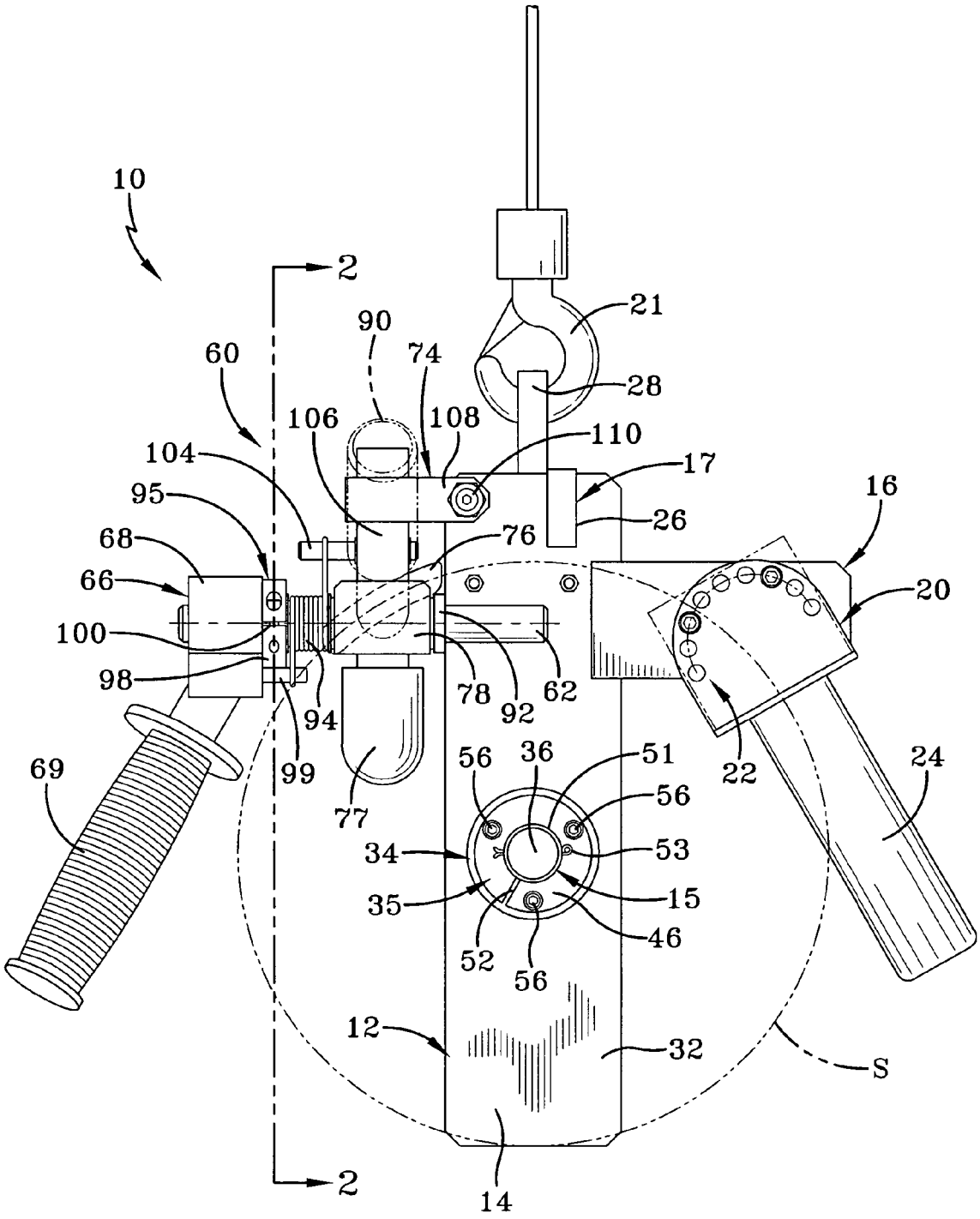
FIG. 1 is a front elevational view of a spool handling device according to the concepts of the present invention including a mechanical latch assembly for releasably securing a spool.

As seen in FIGS. 1, 2, 3, and 4, the spool handling device 10 includes a body, generally indicated by the numeral 12. The body 12 serves as a support for carrying the remaining components of the spool handling device 10. The body includes a base portion 14 supporting a spindle, generally indicated by the numeral 15, capable of receiving the spool. As seen in FIG. 1, the base portion 14 can be a substantially rectangular plate having various components attached thereto.

The body 12 also includes an operating pendant receiving bracket, generally indicated by the numeral 16, and a lifting-eye receiving bracket 17 which are both integrally attached to and depend from the base portion 14. As discussed below, the operating pendant receiving bracket 16 may support an operating pendant, generally indicated by the numeral 20, including suitable controls (not shown) for directing the vertical position of the spool handling device 10 using the hoist. The lifting-eye receiving bracket 17 serves to engage a hook 21 carried by a hoist cable to support the spool handling device 10.

The operating pendant receiving bracket 16, as seen in FIG. 1 can be a substantially rectangular plate attached at one end (by welding or other attachment mechanism) to the base portion 14. The operating pendant receiving bracket 16 extends outwardly from the base portion 14. If necessary, the operating pendant receiving bracket 16 can be canted to facilitate positioning of the operating pendant 20. As seen in FIG. 1, the operating pendant may include a semi-circular pattern of apertures 22. As such, a handle 24 attached to the operating pendant 20 can be positioned in various angular orientations using the circular pattern of apertures 22. The operating pendant 20 may include conventional controls (not shown) for controlling the position of the spool handling device 10.

The lifting-eye receiving bracket 17 can also be a substantially rectangular plate attached to the base portion 14. The lifting-eye receiving bracket 17 can be welded or otherwise attached to the base portion 14. For example, as seen in FIG. 1, a notch 26 is provided in the base portion 14 to allow the lifting-eye receiving bracket 17 to be welded in position therein. The lifting-eye receiving bracket 17 extends outwardly from the base portion 14 to support a lifting-eye, generally indicated by the numeral 25. The lifting-eye 25 is attached to the lifting-eye receiving bracket 17 as by bolts 27 or other suitable fasteners, and includes a lever arm 28 having an aperture 29 which may be proximate the distal end thereof. The aperture 29 is adapted to receive the hook 21. If necessary, the lifting-eye 25 can be interchanged with other lifting-eyes having lever arms 28 of differing lengths. In this manner it is possible to balance the spool handling device 10 carrying a mounted spool S with its axis in a substantially horizontal orientation irrespective of the axial length of a particular spool S. The bolts 27 permit replacement of one lifting-eye 25 with another when a different size of spools are to be handled.

To grip a spool S using the spool handling device 10, the spool is initially received on the spindle 15, and, thereafter, releasably secured in position on the spindle 15. If necessary, the spindle 15 can be interchanged with other spindles having different diameters to accommodate spools S having various sizes of receiving apertures A.

The base portion 14 is configured to support the spindle 15. For example, to facilitate attachment of the spindle 15, the base portion 14 includes a spindle receiving aperture 30 (FIG. 2A) formed between a first surface 32 and a second surface 33. A hub, generally indicated by the numeral 34, is formed on the first surface 32 around the spindle receiving aperture 30. The hub 34 interacts with a tapered bushing 35 to secure the spindle 15 to the base portion 14.

The spindle 15 includes an attachment portion 36, a working portion 37, and an annular edge 38 formed between the attachment portion 36 and working portion 37. The attachment portion 36 is configured to fit through the spindle receiving aperture 30. For example, when the attachment portion 36 is inserted into the spindle receiving aperture 30, the annular edge 38 interfaces with the second surface 33. Furthermore, a part of the attachment portion 36 extends outwardly from the first surface 32 and through the hub 34.

Figure 2:
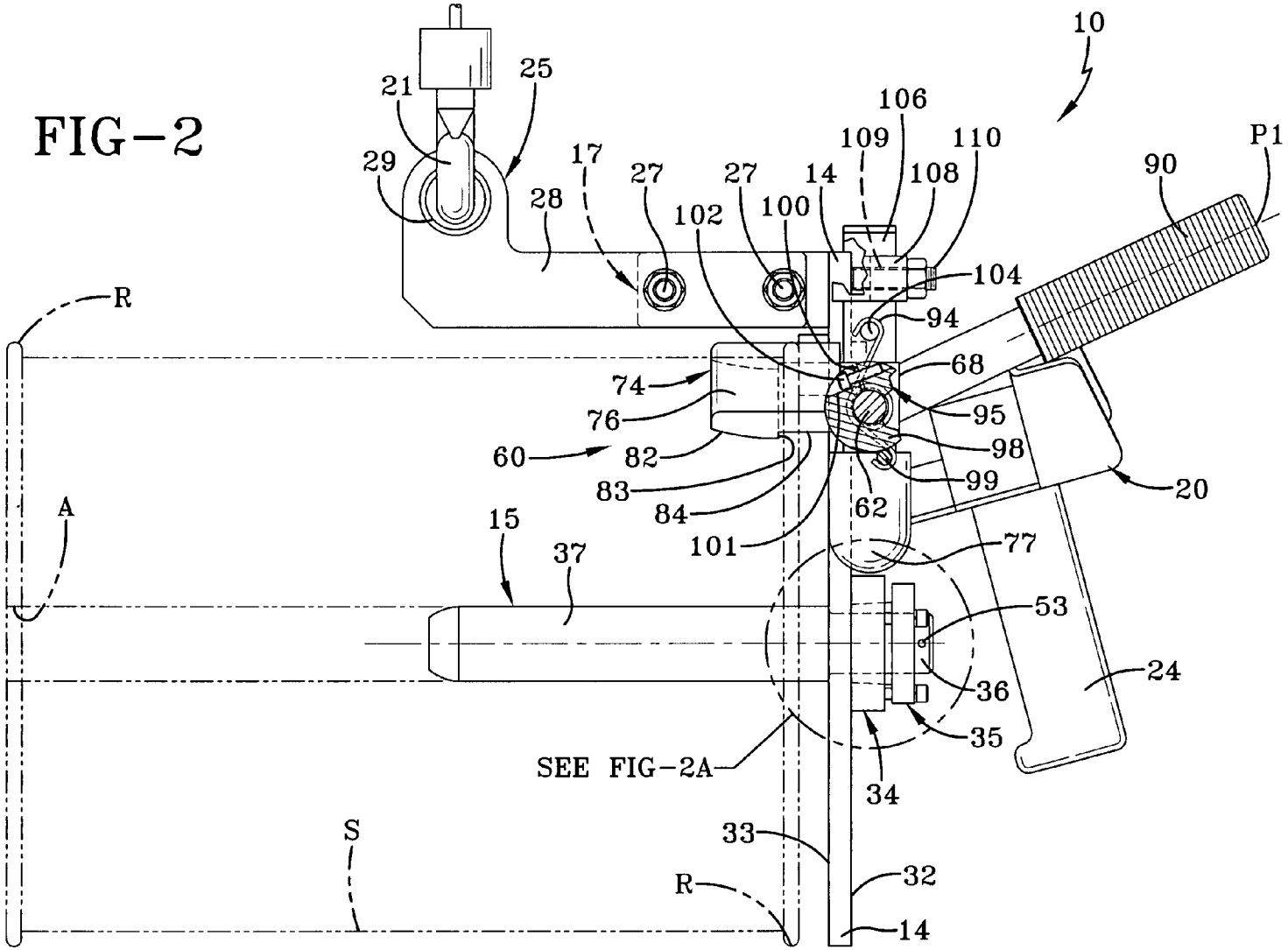
FIG. 2 is a cross-sectional view taken substantially along Line 2—2 of FIG. 1 showing the mechanical latch assembly in an engaged position.
Figure 2A:
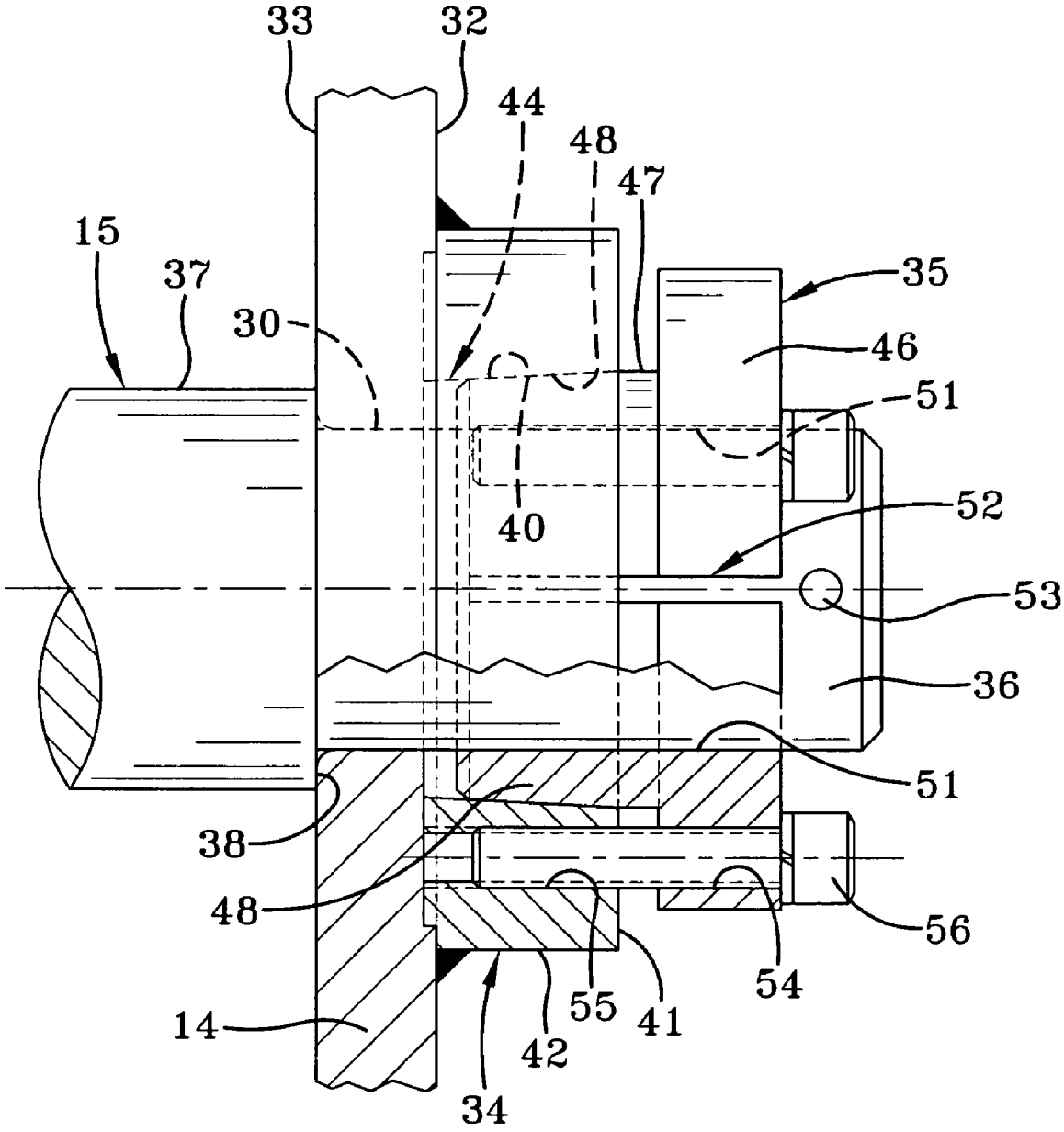
FIG. 2A is an enlarged fragmentary view of the part of the device indicated in FIG. 2, with portions broken away and shown in cross section.

As seen in FIG. 2A, the hub 34 includes a frusto-conical surface 40, a rim surface 41, and a cylindrical surface 42. The frusto-conical surface 40, together with the portion of the first surface 32 surrounding the spindle receiving aperture 30, define a recess 44 for receiving the tapered bushing 35. Moreover, the tapered bushing 35 includes a rim portion 46, a cylindrical portion 47, and a frusto-conical portion 48. The frusto-conical portion 48 interfaces with the frusto-conical surface 40 of the hub 34 when the tapered bushing 35 is inserted into the recess 44.

A bore 51 extends through the rim portion 46, cylindrical portion 47, and frusto-conical portion 48 of the tapered bushing 35, and a compression channel 52 extends radially through and axially along the tapered bushing 35. The bore 51 is sized to receive the part of attachment portion 36 of the spindle 15 which extends outwardly from the first surface 34 through the hub 34. As the frusto-conical portion 48 increasingly interfaces with the frusto-conical surface 40, the compression channel 52 is configured to close, thereby decreasing the diameter of the bore 51. The decreasing diameter of the bore 51 clamps the spindle 15 in a selected position with respect to the base portion 14.

Thus, to secure the spindle 15 to base portion 14, the attachment portion 36 is initially inserted through the spindle receiving aperture 30. Thereafter, the tapered bushing 35 is located on the part of the attachment portion 36 which extends outwardly from the first surface 32 through the hub 34. A pin 53 is inserted through the distal end of the attachment portion 36 to maintain the position of the tapered bushing 35 with respect to the attachment portion 36, and to, after the tapered bushing 35 is attached to the base portion 14, serve as a safety feature, and prevent the spindle 15 from unexpectedly pulling away from the spool handling device 10 if the tapered bushing 35 is not tightened. Subsequently, the tapered bushing 35 is attached to the hub 34 to secure the spindle 15 to the base portion 14. The attachment of the tapered bushing 35 to the hub 34 increases the interface of the frusto-conical surface 40 with the frusto-conical surface 48 to close the compression channel 52, decrease the diameter of the bore 51, and clamp the spindle 15 in position with respect to the base portion 14.

To facilitate attachment of the tapered bushing 35 to the hub 34, various apertures are provided in the hub 34 and tapered bushing 35. For example, a plurality of apertures 54 are provided through the rim portion 46 of the tapered bushing 35. The apertures 54 are circumferentially spaced to communicate with mating threaded apertures 55 provided in the hub 34. As seen in FIG. 2A, the threaded apertures 55 extend into the rim surface 41. Machine screws 56 are inserted through the apertures 54 into the threaded apertures 55 to attach the tapered bushing 35 to the hub 34.

During attachment of the tapered bushing 35 to the hub 34, the frusto-conical portion 48 is inserted into the recess 44, and the frusto-coni interfaces with the frusto-conical portion 48. Tightening of the screws 56 in the threaded apertures 55 draws the tapered bushing 35 axially toward the hub 34. Such contact allows the frusto-conical portion 48 to slide along the frusto-conical surface 40, thereby causing the compression channel 52 to close. The closing of the compression channel 52 decreases the diameter of the bore 51 to clamp the spindle 15 in position with respect to the base portion 14.

The spindle 15 can be interchanged with other spindles having working portions 37 with differently sized diameters provided the other spindles include attachment portions 36 sized to fit through the spindle receiving aperture 30. These other spindles can accommodate spools S having various sizes of receiving apertures A, and can be attached to the base portion 14 using the above-described interaction between the hub 34 and tapered bushing 35.

The spool handling device 10 includes an attachment mechanism, generally indicated by the numeral 60, for releasably securing a spool S on the spindle 15. The attachment mechanism 60 includes a pivot shaft 62 connected at one end to base portion 14 by welding or other attachment mechanism. As seen in FIG. 1, a handle assembly, generally indicated by the numeral 66, is fixedly attached to the pivot shaft 62. Various components of the attachment mechanism 60 are disposed on the pivot shaft 62 between the base portion 14 and handle assembly 66. The handle assembly 66 includes a handle block 68 and a handle 69 attached to the handle block 68 for grasping by an operator.

Figure 3:
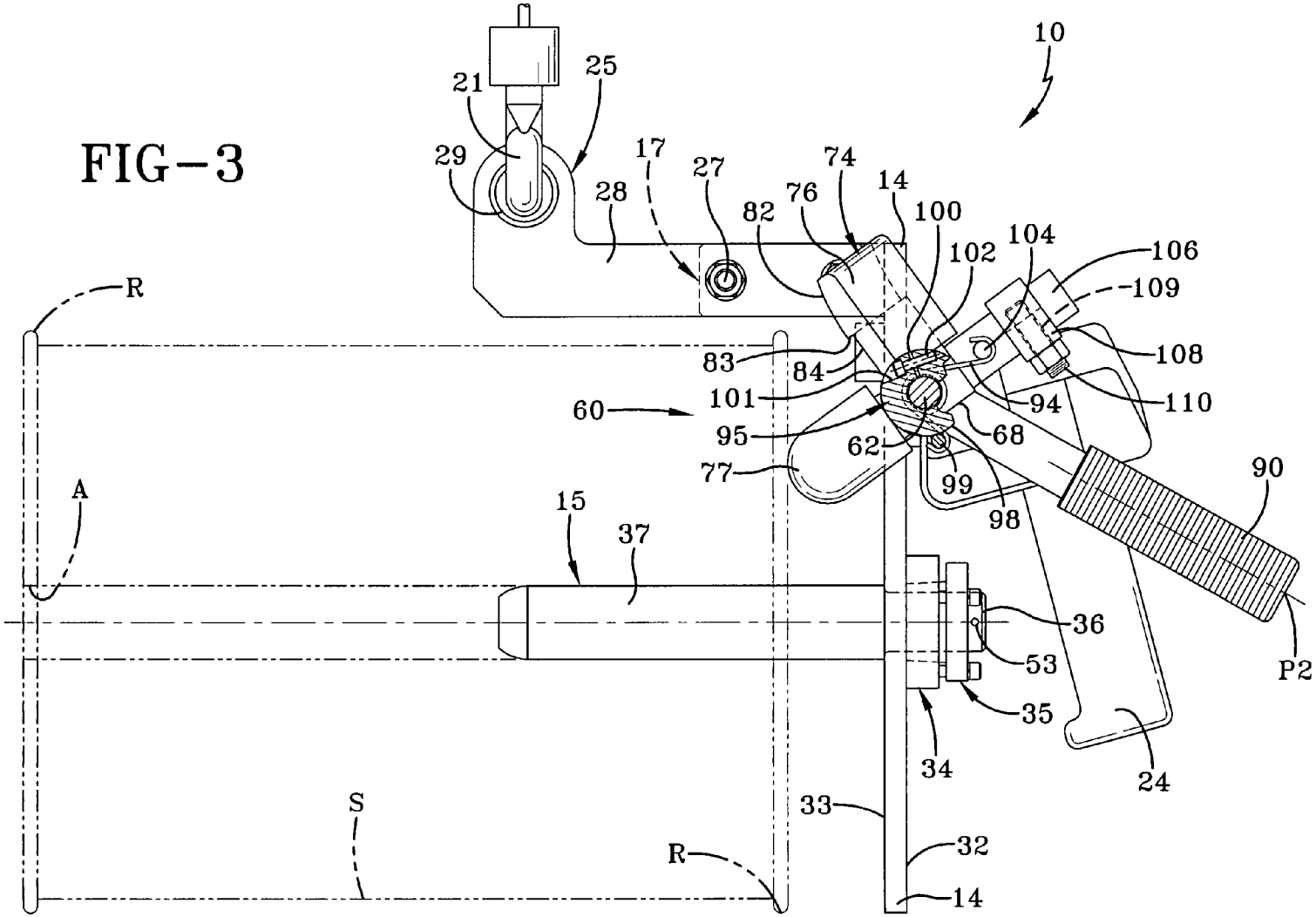
FIG. 3 is a cross-sectional view similar to FIG. 2 showing the mechanical latch assembly in a disengaged position.

As seen in FIGS. 1, 2, 3, and 4, a mechanical latch assembly, generally indicated by the numeral 74, is provided as part of the attachment mechanism 60. The mechanical latch assembly 74 is pivotally carried by the pivot shaft 62 between the base portion 14 and handle assembly 66, and, as best seen in FIGS. 2 and 3, is pivotable between an engaged position P1 and a disengaged position P2, respectively. The mechanical latch assembly 74 includes a latch 76 used to selectively engage the flange R of a spool S to releasably secure spools on the spindle 15. In addition, the mechanical latch assembly 74 includes an ejection arm 77 used to assist in removal of the spool S from the spindle 15. The mechanical latch assembly 74 also includes a pivot block 78 (FIG. 1) which joins the latch 76 to the ejection arm 77, and is rotatable about the pivot shaft 62.

Figure 4:
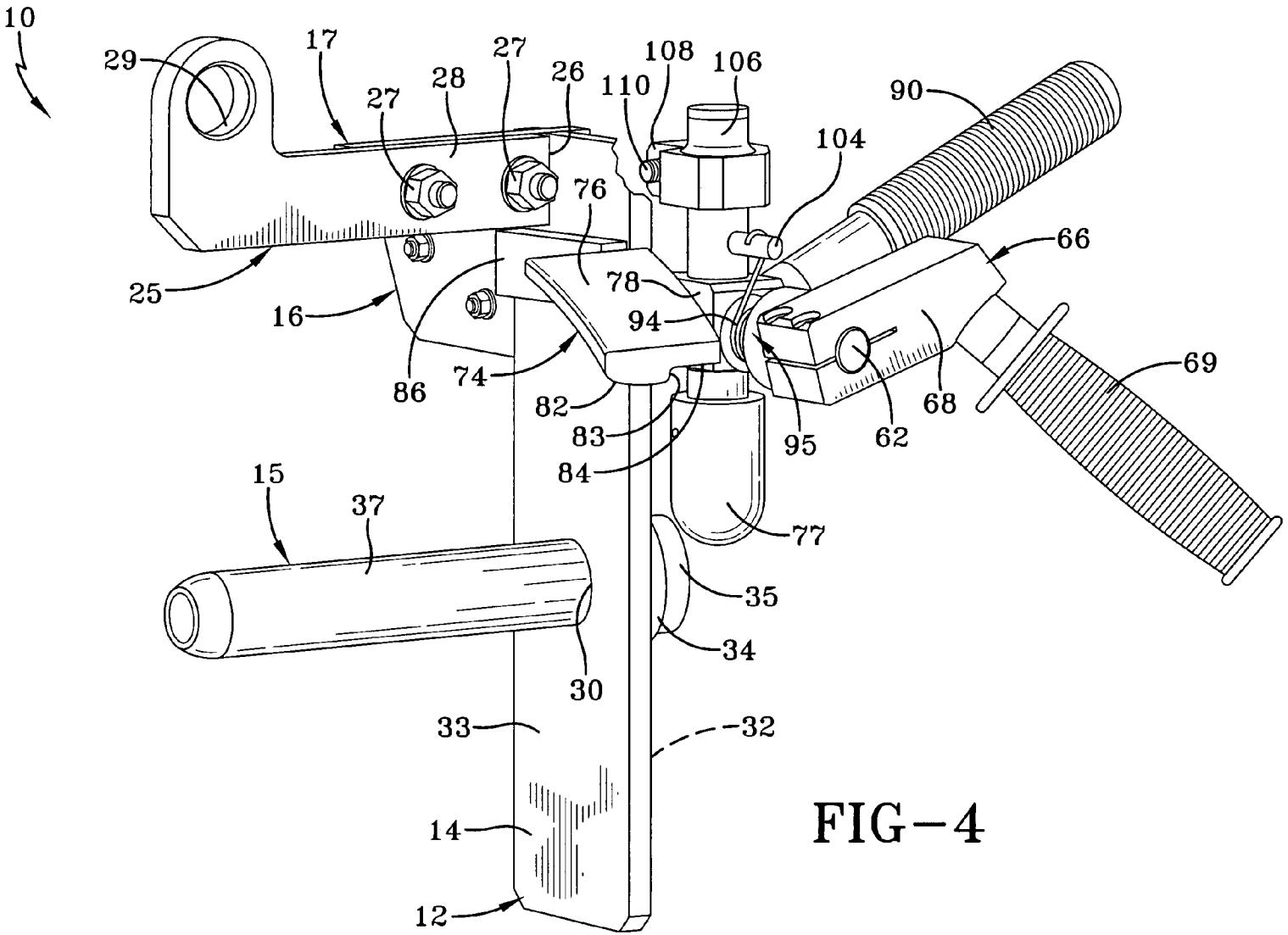
FIG. 4 is a rear perspective view of the spool handling device of FIG. 1.

As seen in FIG. 4, the latch 76 has a curved shape to accommodate a flange R of a spool S. The latch 76 includes a lip portion 82 having an engagement surface 83, and a recessed portion 84 to receive the flange R. Thus, when the mechanical latch assembly 74 is in the engaged position P1, the flange R is received in the recessed portion 84. That is, when the mechanical latch assembly 74 is in the engaged position P1, the flange is entrapped between a bumper 86 (FIG. 4) attached to the base portion 14 and engagement surface 83 adjacent the recessed portion 84.

The mechanical latch assembly 74 is configured such that if a spool S unintentionally begins to slide off the spindle 15, the force exerted by the flange R of a spool S against the engagement surface 83 will tend to maintain the mechanical latch assembly 74 in the engaged position P1 to retain the spool S on the spool handling device 10. For example, as seen in FIGS. 2 and 4, a majority of the latch 76 is attached to the pivot block 78 at a position above the pivot axis of the mechanical latch assembly 74 on the pivot shaft 62. As such, a force exerted by the flange of a spool S against the engagement surface 83 generates a moment in the mechanical latch assembly 74. From the vantage point of FIG. 2, the moment is generated in a counter-clockwise direction about the pivot axis of the mechanical latch assembly 74 on the pivot latch 76. As such, when the moment is applied through the mechanical latch assembly 74, the counter-clockwise direction of the moment (FIG. 2) forces the mechanical latch assembly 74 to remain in the engaged position P1. Consequently, any force exerted by the flange R of the spool S against the engagement surface 83 generates a moment which maintains the mechanical latch assembly 74 in the engaged position P1, and, in so doing, keeps the flange R entrapped between the bumper 86 and engagement surface 83.

To assist removal of the spool from the spool handling device 10, the mechanical latch assembly 74 is actuated. In this respect, the mechanical latch assembly 74 includes a handle 90 attached to the pivot block 78. The handle 90 enables the operator to readily pivot the mechanical latch assembly 74 from the engaged position P1 to the disengaged position P2. Initially, such pivotal movement releases the flange R of the spool S from the between the bumper 86 and engagement surface 83. Further pivotal movement brings the ejection arm 77 into contact with the body portion of the spool, and subsequently pushes the spool along the spindle 15. As such, the ejection arm 77 is capable of effecting ejection of the spool from the spindle 15.

To facilitate operation of the mechanical latch assembly 74, a spacer 92, in addition to a torsion spring 94 and a spring restraint 95 are provided on the pivot shaft 62. As seen in FIG. 1, the spacer 92 is provided to offset the pivot block 78 from the base portion 14. Furthermore, as discussed below, the torsion spring 94 is provided to bias the mechanical latch assembly 74 toward the engaged position P1, and the spring restraint 95 is provided to maintain the position of one extremity of the torsion spring 94.

As seen in FIG. 1, the spring restraint 95 is disposed on the pivot shaft 62 adjacent the handle assembly 66. The spring restraint 95 is formed from a set collar 98 and an axially projecting post 99 attached to the set collar 98. The set collar 98 includes a radial opening 100, and a recessed fastener receiving aperture 101 provided on either side of the radial opening 100 (FIG. 2). To fixedly attach the spring restraint 95 to the pivot shaft 62, the recessed fastener receiving aperture 101 is threaded to receive a screw-type fastener 102. Thus, when received in the fastener receiving aperture 101, the screw-type fastener 102 closes the radial opening 100 to clamp the set collar 98 around the pivot shaft 62 to maintain it axially.

The torsion spring 94, as seen in FIG. 1, is disposed on the pivot shaft 62 between the spring restraint 95 and mechanical latch assembly 74. One end of the torsion spring 94 is attached to the post 99, and the other end of the torsion spring 94 is attached to a post 104 integrally formed with the mechanical latch assembly 74. Because one end of the torsion spring 94 is attached to the post 99, and the spring restraint 95 is fixedly attached to the pivot shaft 62, the torsion spring 94 biases the mechanical latch assembly 74 toward the engaged position P1. Conversely, the torsion spring 94 serves to resist pivotal movement of the mechanical latch assembly 74 from the engaged position P1 to the disengaged position P2.

The mechanical latch assembly 74 also includes a stop arm 106 attached to the pivot block 78. As seen in FIG. 1, the stop arm 106 includes an integrally attached stop bracket 108 with a threaded aperture 109 for receiving an adjustable bolt 110. The adjustable bolt 110 is provided to contact the base portion 14 to inhibit pivotal movement of the mechanical latch assembly 74. As seen in FIGS. 2 and 3, when the adjustable bolt 110 is received in the threaded aperture 109, the mechanical latch assembly 74 is prevented from pivoting beyond the engaged position P1. The engaged position P1 can be varied by axially adjusting the position of the bolt 110 relative to the stop bracket 108.

During operation of the spool handling device 10, a spool S is releasably secured in position on the spindle 15. Initially, the operator adjusts the spool handling device 10 so that the spindle 15 is in a vertical position or a horizontal position. The operator can adjust the orientation of the spool handling device 10 using the handle 24 (of the operating pendant 20) and handle 69. As such, the operator orients the spool handling device 10 to respectively accommodate spools S having the axis A vertical or horizontal. Subsequently, the working portion 37 of the spindle 15 is inserted by the operator into the receiving aperture A of the spool S.

During the insertion of the spindle 15 into the receiving aperture A, the flange R of the spool S contacts the lip portion 82 of the latch 76. Further contact between the flange R of the spool S with the latch 76 forces the mechanical latch assembly 74 to pivot away from the engaged position P1. As such, continued insertion of the spindle 15 into the receiving aperture A forces the mechanical latch assembly 74 to pivot away from the engaged position P1 until the flange R is received in the recess portion 84. Thereafter, the mechanical latch assembly 74, due to the bias provided by the torsion spring 94, returns to the engaged position P1 with the flange R being entrapped between the bumper 86 and engagement surface 83. When the flange R of the spool S is entrapped between the bumper 86 and engagement surface 83, the spool is releasably secured in position on the spindle 15 so that it can, as discussed above, be transported or otherwise repositioned by a operator. Once the spool handling device 10 is positioned and oriented such that the aperture A in the spool S reposes in part on a spindle of a creel or the like, the operator actuates the mechanical latch assembly 74 to the disengaged position P2. This releases the flange R of the spool S from the latch 76 and the ejection arm 79 assists in displacing the spool S from the spindle 15 onto the spindle of a creel from which the strand material is payed out.

Thus, it should be evident that the spool handling device disclosed herein carries out one or more of the objects of the present invention set forth above and otherwise constitutes an advantageous contribution to the art. As will be apparent to persons skilled in the art, modifications can be made to the preferred embodiment disclosed herein without departing from the spirit of the invention, the scope of the invention herein being limited solely by the scope of the attached claims.

The invention claimed is:

1. A spool handling device for engaging and disengaging a spool comprising, a base, a spindle supported by said base and adapted to receive the spool, a latch assembly pivotally mounted relative to said base and including a handle and a latch for releasably securing the spool on said spindle, an ejection arm for assisting in removal of the spool from said spindle, a pivot shaft connected to said base, said latch assembly being rotatably mounted on said pivot shaft for movement between an engaged position and a disengaged position, wherein said handle is adapted to pivot said latch from said engaged position to said disengaged position and actuation of said handle brings said ejection arm into engagement with the spool to displace the spool from said spindle.

2. A spool handling device according to claim 1, wherein said latch assembly includes a pivot block joining said latch and said ejection arm.

3. A spool handling device according to claim 2, wherein said pivot block includes an aperture for receiving said pivot shaft.

4. A spool handling device according to claim 1, wherein said latch assembly has a torsion spring received on said pivot shaft and operative on said latch for biasing said latch assembly toward said engaged position.

5. A spool handing device according to claim 1, wherein said latch includes a recessed portion, for engaging the spool when the spool is releasably secured on said spindle.

6. A spool handling device according to claim 5 further comprising, a bumper attached to said base, wherein said latch includes a lip having an engagement surface so that the spool, when received in said recessed portion, is entrapped between said bumper and said engagement surface.

7. A spool handling device according to claim 1, wherein said spindle is one of a plurality of spindles sized to accommodate the spool.

8. A spool handing device according to claim 7, wherein a hub attached to said base matingly receives a tapered bushing on said spindle to secure said spindle to said base.

9. A spool handling device for engaging and disengaging a spool for transport and reorientation comprising, a base carrying a spindle adapted to support the spool, a shaft extending from said base, a latch pivotally mounted on said shaft for selectively engaging and disengaging the spool, a spring on said shaft operative to bias said latch toward engaging the spool, a handle on said shaft for manual grasping to assist in manipulating a spool supported on said spindle and an ejection arm pivotally mounted on said shaft to assist in removal of a spool from said spindle.

10. A spool handling device according to claim 9, wherein a pivot block rotatable about said shaft joins said latch and said ejection arm.

11. A spool handling device according to claim 10, wherein a second handle attached to said pivot block is operable to disengage said latch and actuate said ejection arm.

12. A spool handling device according to claim 9, wherein a second handle for manipulating a spool supported on said spindle is fixedly supported relative to said base and said shaft.

13. A spool handling device for engaging and disengaging a spool comprising, a base, a spindle supported by said base and adapted to receive the spool, a latch assembly pivotally mounted relative to said base and including a latch for releasably securing the spool on said spindle, an ejection arm for assisting in removal of the spool from said spindle, and a hub attached to said base that matingly receives a tapered bushing on said spindle to secure said spindle to said base.

14. A spool handling device according to claim 13, further comprising a pivot shaft connected to said base, said latch assembly being rotatably mounted on said pivot shaft for movement between an engaged position and a disengaged position.

15. A spool handling device according to claim 14 wherein said latch assembly includes a pivot block joining said latch and said ejection arm.

16. A spool handling device according to claim 15, wherein said pivot block includes an aperture for receiving said pivot shaft.

17. A spool handling device according to claim 14, wherein said latch assembly has a torsion spring received on said pivot shaft and operative on said latch for biasing said latch assembly toward said engaged position.

18. A spool handing device according to claim 13, wherein said latch includes a recessed portion, for engaging the spool when the spool is releasably secured on said spindle.

19. A spool handling device according to claim 18 further comprising, a bumper attached to said base, wherein said latch includes a lip having an engagement surface so that the spool, when received in said recessed portion, is entrapped between said bumper and said engagement surface.

20. A spool handling device according to claim 13, further comprising a pivot shaft connected to said base, and a pivot block received on said pivot shaft, said latch assembly being rotatably mounted on said pivot shaft for movement between an engaged position and a disengaged position, wherein said latch assembly includes said pivot block joining said latch and said ejection arm, and wherein a majority of said latch is attached to said pivot block at a position above a pivot axis of said mechanical latch assembly so that any force applied to the spool when secured to said spindle generates a moment to force said latch assembly to remain in said engaged position.

* * * * *